US008439736B2

(12) United States Patent
Reed et al.

(10) Patent No.: US 8,439,736 B2
(45) Date of Patent: May 14, 2013

(54) EXTENDED PLAY GAMING SYSTEMS AND METHODS

(75) Inventors: Bryan Lynn Reed, Suwannee, GA (US); Marcel Bouffard, Flowery Branch, GA (US)

(73) Assignee: Cadillac Jack, Duluth, GA (US)

( * ) Notice: Subject to any disclaimer, the term of this patent is extended or adjusted under 35 U.S.C. 154(b) by 1259 days.

(21) Appl. No.: 11/862,438

(22) Filed: Sep. 27, 2007

(65) Prior Publication Data

US 2009/0088241 A1 Apr. 2, 2009

(51) Int. Cl.
*A63F 9/24* (2006.01)

(52) U.S. Cl.
USPC ..... 463/16

(58) Field of Classification Search ..... 463/16
See application file for complete search history.

(56) References Cited

U.S. PATENT DOCUMENTS

| | | | | |
|---|---|---|---|---|
| 5,855,514 | A * | 1/1999 | Kamille | 463/17 |
| 6,159,098 | A * | 12/2000 | Slomiany et al. | 463/25 |
| 6,237,913 | B1 * | 5/2001 | Kamille | 273/139 |
| 2002/0142822 | A1 * | 10/2002 | Baerlocher et al. | 463/16 |
| 2003/0218303 | A1 * | 11/2003 | Walker et al. | 273/292 |

OTHER PUBLICATIONS

Definition of "Continuous" Merriam Webster's Collegiate Dictionary, 10th Edition Merriam Webster's, Incorporated, 1997.*

* cited by examiner

*Primary Examiner* — Corbett B Coburn

(57) ABSTRACT

Various embodiments of extended play gaming systems and methods are disclosed. One method embodiment, among others, comprises providing a user interface that enables extended play in an electronic game, and providing an opportunity for increased compensation that varies based on when extended play is terminated.

9 Claims, 6 Drawing Sheets

EXTENDED PLAY GAMING SYSTEMS AND METHODS

TECHNICAL FIELD

The present disclosure relates to gaming systems, and more particularly, to electronic gaming systems.

BACKGROUND

Gaming machines such as mechanically driven slot machines have been a staple of the gaming and entertainment industries for years. With the advent of computers, electronic forms of gaming machines such as video slots, video bingo, video poker, video keno and video blackjack have emerged and have become increasingly popular. Such electronic devices continue to grow in popularity with the development of enhanced computer-generated graphics and sounds, making them more attractive to a wider audience of participants.

With the recent growth in the electronic gaming machine market, competition between manufacturers to place their equipment in available venues has become fierce. When selecting which machines to put into their facilities, the operators of gaming establishments give substantial consideration to their patrons' perception of a game as entertaining and exciting. To attain this goal, gaming machines frequently employ extended play in the form of "bonus" rounds in connection with the base game. Typically, the bonus game is tied to the base game through a common theme. For example, a gaming machine with a racecar motif may employ an automobile race in the bonus round in which the finish place of the player's car determines the payout. The bonus game is triggered upon the occurrence of a certain event occurring in the base game. Such bonus games produce a greater degree of player excitement resulting from the use of enhanced sounds and graphics.

Because bonus rounds serve to keep players entertained which, in turn, yields greater profits to the gaming machine operators, there is a continuing need to develop novel concepts to maintain excitement and attract new players. The present disclosure is directed to satisfying these needs.

SUMMARY

Various embodiments of extended play gaming systems and methods are disclosed. One method embodiment, among others, comprises providing a user interface that enables play of a bonus round in an electronic game in which the awarded compensation is dependent upon when the player elects to terminate play of the bonus round.

Other systems, methods, features, and advantages of the present disclosure will be or become apparent to one with skill in the art upon examination of the following drawings and detailed description. It is intended that all such additional systems, methods, features, and advantages be included within this description, and be within the scope of the present disclosure.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the disclosed systems and methods. Moreover, in the drawings, like reference numerals designate corresponding parts throughout the several views.

DETAILED DESCRIPTION

Disclosed herein are various embodiments of extended play gaming systems and methods (herein, also collectively gaming systems). Such gaming systems are configured to utilize a trigger value during extended play or a bonus game (note that the phrases "extended play" and "bonus game" or "bonus play" are used interchangeably throughout this disclosure). The trigger value in turn serves as a basis for the amount of compensation to be awarded during bonus play. For instance, in one embodiment, during bonus play, the player is encouraged or tempted (through various visual, audio, and/or tactile effects) to terminate play prematurely. Failure to terminate play before the trigger value has been reached may result in a nominal award, or no award at all, whereas termination before the trigger value is reached may result in added compensation. Other variations are contemplated and described below.

The present disclosure now will be described more fully with reference to the accompanying drawings, in which some, but not all, embodiments are shown. Indeed, the disclosed systems and methods may be embodied in many different forms and should not be construed as limited to the embodiments set forth herein. Rather, these embodiments are provided so that this disclosure will satisfy applicable legal requirements.

Figure 1:
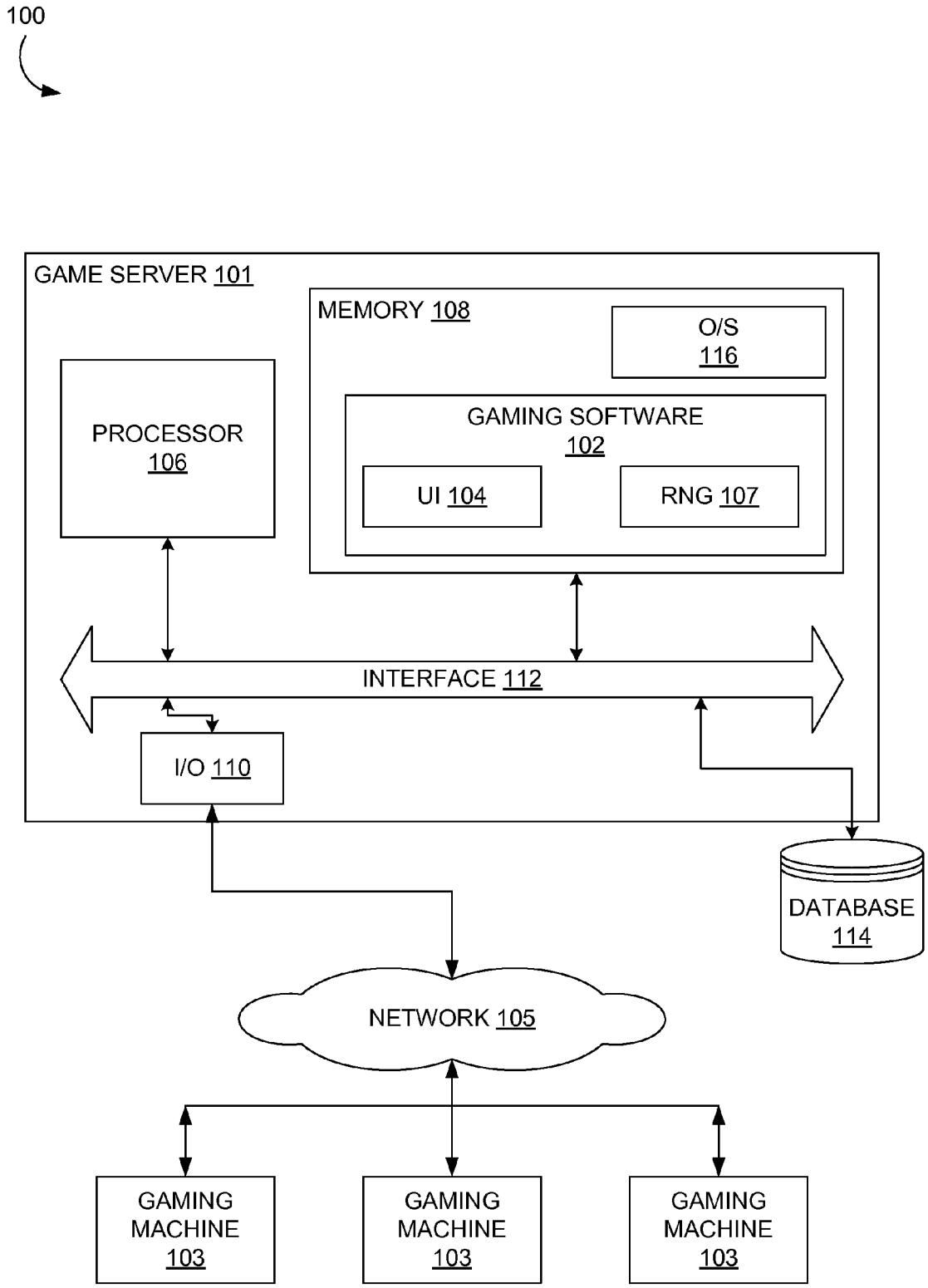
FIG. 1 is a block diagram of an embodiment of an extended play gaming system.

FIG. 1 is a block diagram of an embodiment of a gaming system 100. The gaming system 100 includes a game server 101 networked to a plurality of individual gaming machines 103 via a network 105 (e.g., a local area network (LAN) such as an Ethernet connection, a wide area network (WAN), among or other media). Each gaming machine 103 may be located locally or remotely with respect to one another.

In one embodiment, the game server 101 can implement gaming software 102. The gaming software 102 can be implemented in software, as an executable program, and can be executed by a special or general purpose digital computer, such as a personal computer (PC; IBM-compatible, Apple-compatible, or otherwise), workstation, minicomputer, or mainframe computer. The gaming software 102 includes a user-interface (UI) module 104 that provides display functions according to well-known web-page or screen display generation and formatting mechanisms. The gaming software 102 also includes a random number generator (RNG) 107. The RNG 107 comprises one or more modules of code configured to determine whether to commence extended play, to define or initiate parameters (and adjust one or more of such parameters) involved in implementing an extended play session, and to determine disbursement awards. In certain embodiments, at least some of the functionality of the gaming software 102, such as random number generation, can be implemented in hardware. Although shown integral to the gaming software 102, one having ordinary skill in the art would understand in the context of this disclosure that the UI module 104 and/or RNG 107 can be modules distinct from the gaming software 102, and that each module may be further configured using a plurality of submodules.

Generally, in terms of hardware architecture, as shown in FIG. 1, the game server 101 includes a processor 106, memory 108, and one or more input and/or output (I/O) devices or peripherals 110 that are communicatively coupled via a local interface 112. The local interface 112 can be, for example, one or more buses or other wired or wireless connections. The local interface 112 may have additional elements (not shown) to enable communications, such as controllers, buffers (caches), drivers, repeaters, and receivers. Further, the local interface 112 may include address, control, and/or data connections to enable appropriate communications among the aforementioned components. The game server 101 can also communicate with the database 114 via the local interface 112. The local database 114 can be external to or integral to the game server 101.

The processor 106 is a hardware device capable of executing software, particularly that stored in memory 108. The processor 106 can be any custom made or commercially available processor, a central processing unit (CPU), an auxiliary processor among several processors associated with the game server 101, a semiconductor based microprocessor (in the form of a microchip or chip set), a macroprocessor, or generally any device for executing software instructions.

Memory 108 can include any one or combination of volatile memory elements (e.g., random access memory or RAM) such as DRAM, SRAM, or SDRAM and non-volatile memory elements (e.g., ROM, hard drive, tape, CDROM, etc.). Moreover, the memory 108 may incorporate electronic, magnetic, optical, and/or other types of storage media. Note that memory 108 can have a distributed architecture, where various components are situated remote from one another, but can be accessed by the processor 106.

The software in memory 108 may include one or more separate programs, each of which comprises an ordered listing of executable instructions for implementing logical functions. In one example of the game server 101 of FIG. 1, the software in the memory 108 includes the gaming software 102 and a suitable operating system (O/S) 116. The operating system 116 essentially controls the execution of other computer programs, such as the gaming software 102, and provides scheduling, input-output control, file and data management, memory management, and communication control and related services.

The gaming software 102 can be a source program, executable program (object code), script, and/or any other entity comprising a set of instructions to be performed. When a source program is utilized, the program may be translated via a compiler, assembler, interpreter, or the like, which may or may not be included within memory 108, so as to operate properly in connection with the operating system 116. Furthermore, the gaming software 102 can be written as (a) an object oriented programming language, which has classes of data and methods; or (b) a procedure programming language, which has routines, subroutines, and/or functions, for example but not limited to, C, C++, Pascal, Basic, Fortran, Cobol, Perl, Java, ASP, and Ada.

The I/O devices 110 may include input devices such as a keyboard, mouse, scanner, microphone, etc., as well as interfaces to various devices. Furthermore, the I/O devices 110 may also include output devices, such as a printer, display, etc. Finally, the I/O devices 110 may further include devices that communicate both inputs and outputs, for instance a modulator/demodulator (modem for accessing another device, system, or network), a radio frequency (RF) or other transceiver, a telephonic interface, a bridge, a router, etc.

When the game server 101 is in operation, the processor 106 is configured to execute software stored within memory 108, to communicate data to and from memory 108, and to generally control operations of the game server 101 pursuant to the software. The gaming software 102 and the operating system 116, in whole or in part, but typically the latter, are read by the processor 106, perhaps buffered within the processor 106, and then executed.

The gaming software 102 can be stored on any computer readable medium for use by or in connection with any computer related system or method. In the context of this document, a computer readable medium is an electronic, magnetic, optical, or other physical device or mechanism that can contain or store a computer program for use by or in connection with a computer related system or method. The gaming software 102 can be embodied in any computer-readable medium for use by or in connection with an instruction execution system, apparatus, or device, such as a computer-based system, processor-containing system, or other system that can fetch the instructions from the instruction execution system, apparatus, or device and execute the instructions.

Figure 2A:
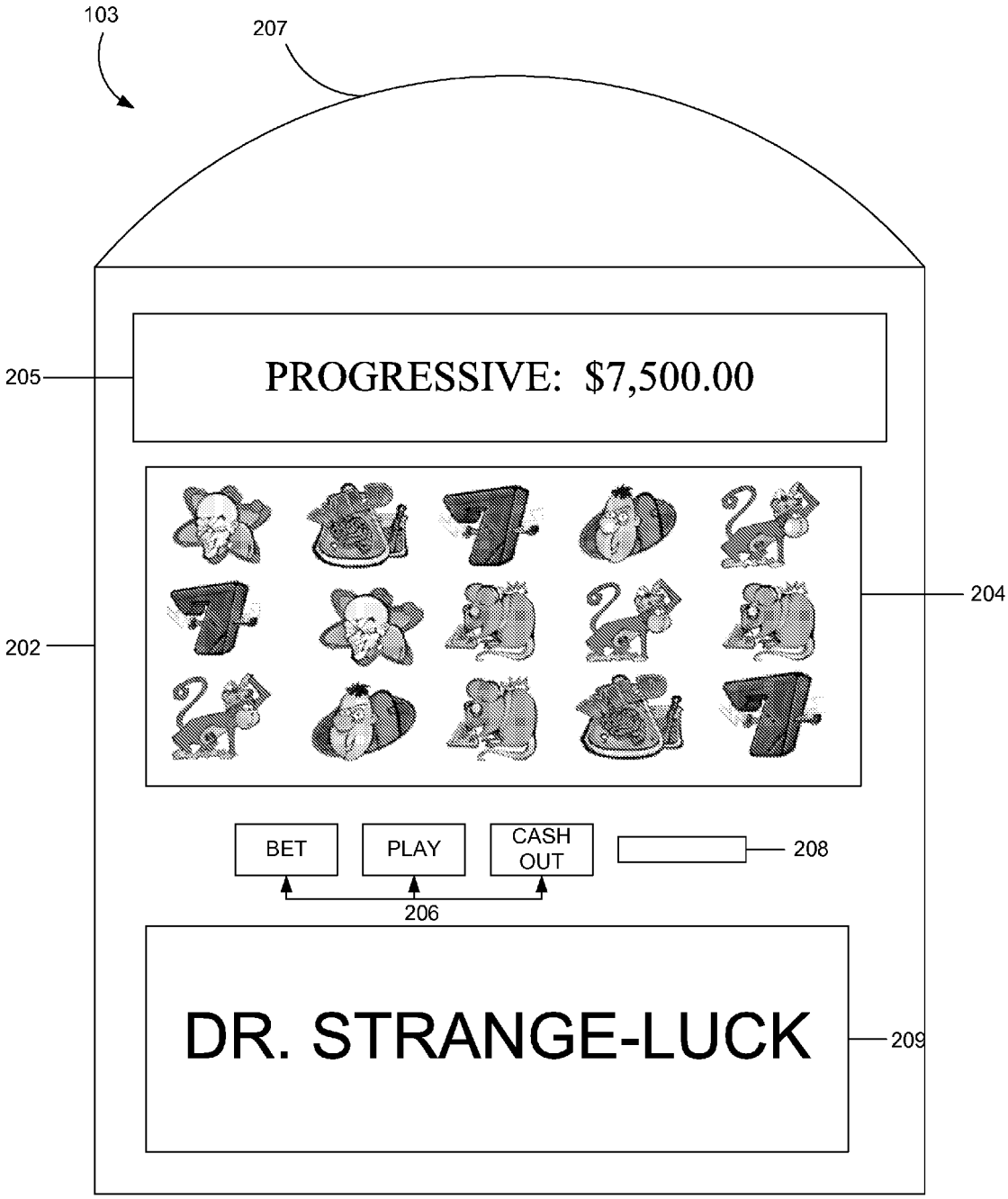
FIG. 2A shows an exemplary gaming machine of the extended play gaming system shown in FIG. 1.

FIG. 2A depicts an embodiment of a video gaming machine 103. It is noted that the term "gaming machine" may refer to any device, activity or mode of play for gaming (e.g., gambling or redemption), amusement, competition, or other purposes. Additionally, "gaming machine" may refer to a "stand alone" player station or console in which case the outcome of game play is determined locally, or part of a server-based network of gaming machines in which case the outcome of game play is centrally determined. The gaming machine 103 includes a cabinet 202 housing a primary display 204 for displaying game events. The primary display 204 may be a mechanical display such as used in traditional slot machines, or a video display such as a flat panel LCD as used in electronic games such as video bingo, video slots, video poker, video keno or video blackjack. The gaming machine 103 may also include a top glass 207 and a belly glass 209 for displaying various information such as game rules or graphics designed to attract players to participate.

Proximate to the primary display 204 are a series of electromechanical buttons 206 positioned on the cabinet for use as a user interface for controlling game play such as selecting a bet amount, commencing play and cashing out. The specific arrangement and function of each of the electromechanical buttons 206 is dependent upon the type of game being played on the gaming machine 103. For example, for a Blackjack game, the electromechanical buttons 206 may include options for placing a bet, cashing out, hitting or standing, doubling down, purchasing insurance and/or splitting. Alternatively, in a poker game, the electromechanical buttons 206 may include options for placing a bet, cashing out and/or designating which cards to keep and which to discard. In one embodiment, the primary display 204 is a "touch screen" upon which icons corresponding to some or all of the electromechanical buttons 206 appear. The user can activate the functions associated with the icons by simply touching the appropriate area of the primary display 204 rather than depressing the electromechanical buttons 206.

The gaming machine 103 also includes a wager input interface 208, such as a bill acceptor into which a player inserts paper currency and receives credit on the gaming machine 103 for the amount deposited. In alternate embodiments, the wager input interface 208 can be a ticket reader, a magnetic card reader, or similar mechanisms, into which the player places a ticket or magnetic card encoded with a monetary value purchased from a cashier's station or vending machine.

A play session of the individual gaming machines 103 commences based on the choice of a player entered at the gaming machine 103. One exemplary manner of play is described below. The player places a wager by inputting currency or a ticket or magnetic card bearing game credits into wager input interface 208 of a primary gaming machine 103. In one embodiment, the gaming machine 103 indicates the amount of money or credit available for the player to bet during play. The player then proceeds to indicate the amount to be wagered on a particular play of the game, up to the lesser of the available game credits or the maximum allowable bet on the gaming machine 103. The player starts play of the game by selecting the appropriate choice among the electromechanical buttons 206. After the placing of a wager and commencing play of the gaming machine 103, the player interacts with the game. For example, if the game being played on the gaming machine 103 is blackjack, the player is dealt cards and subsequently makes decisions whether to stand, hit, double down, split or purchase insurance. Alternatively, if the game is poker, the player is dealt cards and makes decisions to try to achieve the best hand. Play of the game continues in typical fashion. A winning outcome results in the player receiving additional game credits. Conversely, a losing outcome results in the player's wager being forfeited.

Play (e.g., session play) of each of the gaming machines 103 continues until the occurrence of a certain event or events triggering the bonus round. The bonus round can be triggered by any number of events. For example, the triggering of the bonus round can be random or quasi random, such as the time of day (e.g. a bonus round is offered on the first game played after the start of each hour), the number of spins since the last bonus round, the currency played in the game, etc. Alternatively, the bonus round can be invoked when play drops below a certain level, such as to attract additional players to the machine (or retain the ones who are already there). The bonus round can be triggered by a certain arrangement of symbols in the base game (e.g., three cherries along any of the paylines gives a bonus round). Or, the bonus game can be just be for entertainment purposes to reflect the amount awarded in the base game (e.g., a certain bingo pattern yields 100 credits—the arrangement of symbols in the base game may yield 50 credits and the processor causes the bonus round to yield another 50 credits). The list of triggering events is virtually endless. That is, the manner in which the bonus round is invoked can be implemented in one or more of a plurality of different ways, and hence the various gaming system embodiments disclosed herein are not limited in that regard. Responsive to the occurrence of the triggering event, the gaming software 102 commences extended or bonus play.

Figure 2B:
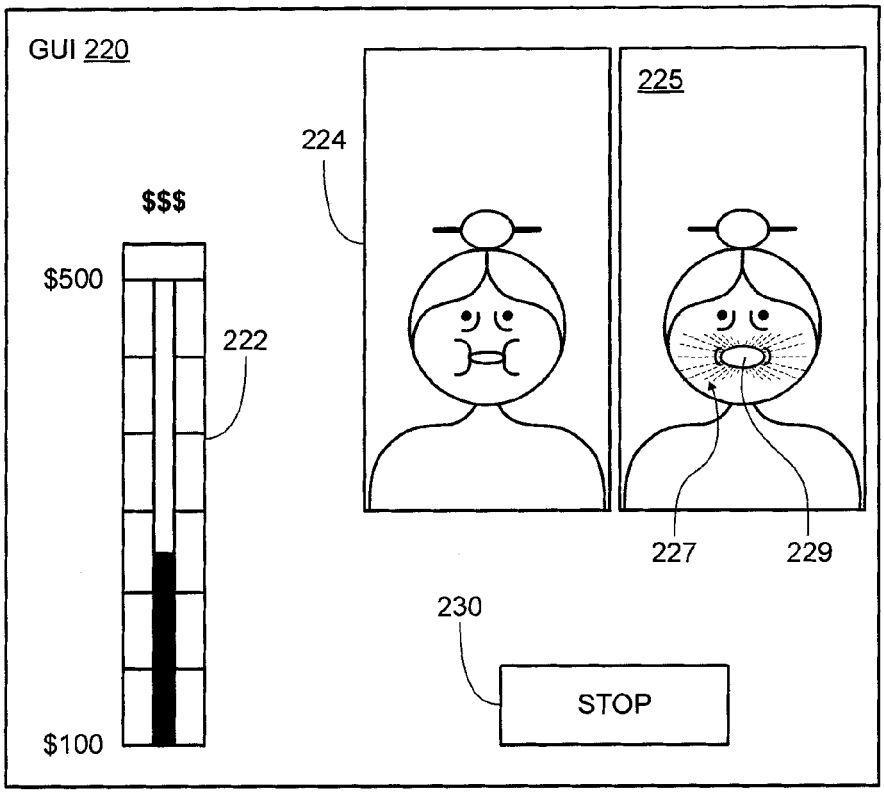
FIG. 2B shows a graphics user interface (GUI) used by the exemplary gaming machine in FIG. 2A in extended play mode.

FIG. 2B illustrates an embodiment of a user interface (e.g., graphic user interface or "GUI") 220 presented by the gaming machine 103 in conjunction with an electronic video game for enabling a player to extend play in the form of a bonus game. The GUI 220 can be presented in or on the primary display 204 of the gaming machine 103. In one embodiment, the GUI 220 comprises a bonus payout indicator 222, a graphic display 224 and a stop button icon 230. Upon commencement of the bonus game, the bonus payout indicator 222 begins to move from an initial amount (e.g., $100) toward a maximum amount (e.g., $500). The graphic display 224 comprises, in one exemplary implementation, a Viking woman preparing to sing an opera aria. One idea of the bonus play is to select the stop button 230 before the Viking woman starts to sing, hence recovering an increased compensation value in the bonus round as indicated by the value of the bonus payout indicator 222. Otherwise, if the Viking woman has begun to sing before the player stops the bonus payout indicator 222 from rising, the player is awarded a nominal award for the bonus round, or no award at all. Other features may be presented, such as a help screen or instruction screen that explains the objective of bonus play, among other features. Upon initiation of bonus play, the graphic display 224 is animated to provide a stimulus or visual effect that tempts or otherwise encourages the player to terminate play prematurely, as explained further below. Audio and/or tactile effects, in combination with or in lieu of visual effects, may be presented as well. The bonus payout indicator 222 provides a status to the player regarding bonus winnings achieved during bonus play.

In one exemplary implementation, the player is trying to achieve the maximum winnings possible from the bonus play while the graphic display 224 seemingly indicates the onset of the bonus game end. In this instance, it may be advantageous to prematurely terminate the bonus game, or, in other words, quit before the trigger value is reached so that the last amount indicated by the bonus payout indicator 222 is paid to the player rather than no award or a mere nominal award in the event of the game terminating itself.

Referring to FIG. 2B, the bonus payout indicator 222 shows a starting point (e.g., $100) and an ending point (e.g., $500). The bonus payout indicator 222 signifies or represents the escalation over time from $100 to $500. Although the bonus payout indicator 222 is configured as a thermometer-like graphic symbol, other graphics may be used (e.g., a staircase, sliding bar graphic, dial, etc.) to represent the progression of potential bonus round payout. Further, although shown without user interaction during the progression (except that required to terminate progression of the bonus payout indicator 222 by depressing the stop button icon 230 to terminate play), in some embodiments, the user can be engaged in a task where various events occurring during implementation of those tasks may advance the progression.

In general, upon commencement of the bonus round, an indicator (e.g., bonus payout indicator 222) starts progressing from the starting point to the ending point (e.g., ticking up in dollar increments). There is a predetermined trigger value unknown to the player which, when reached, ends the bonus round. If the player hasn't terminated the progression prior to reaching this trigger value, the bonus ends and the player is awarded the base amount—$100 in this example. If the player terminates the progression prior to reaching the predetermined trigger value, he or she is awarded the amount reflected by the indicator, knowing that some amount of money will be forfeited. In the embodiment shown in FIG. 2B, the progression is terminated when the Viking lady sings. One variation 225 is that the Viking woman may do something to try and trick the player into terminating the progression, such as clearing her throat, speaking, or making a facial contortion 229. This temptation or deceit 227 wouldn't terminate the progression if the player does not end the progression on his or her own by depressing the stop button 230. The longer the bonus game is played, the more likely the bonus payout indicator is to reach the trigger value.

In another embodiment, the bonus game may be configured in a manner that awards the player a maximum possible award if he or she remains playing until termination is implemented by the gaming software 102 (as opposed to player-initiated termination), while increasing the risk of loss at the game (and hence possible forfeiture of any award earned). That is, the player may terminate the bonus game prematurely, guaranteeing at least some increased compensation (with respect to compensation already earned in the primary preceding bonus play), while forfeiting a larger award made possible by playing the game until the gaming software 102 terminates the game.

Figure 3:
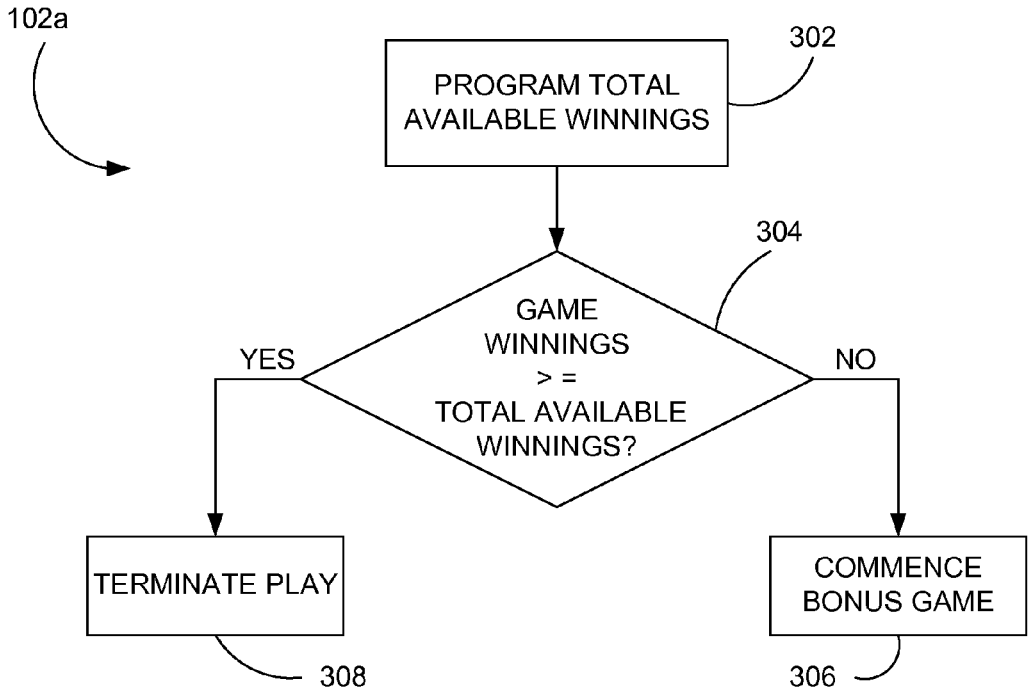
FIG. 3 is a flow diagram that illustrates an embodiment of an extended play gaming method.

FIG. 3 illustrates one method embodiment, 102*a*, which is implemented to make the determination as to whether bonus play is commenced. That is, the gaming software 102 routinely makes a determination as to eligibility to engage in bonus play as prompted by a triggering event. For example, the gaming software 102 may comprise a predetermined amount of total available winnings at start-up and/or adjusted through random number generation at the commencement of each play session by the same or different players (302). As a play session progresses, the player may earn an award of X, yet the base game reflects an award of less than X. A determination is made by the gaming software 102 that the base game award is less than the total award (i.e., the predetermined total available winnings) and there is an opportunity for the player to increase his or her compensation through a bonus game (304). That is, if the game winnings are not equal to or greater than the total available winnings, the gaming method 102*a* commences a bonus game (306). Otherwise, the gaming software terminates play (308). Note that the determination can be done in other ways, such as determining whether the game winnings is less than or equal to total winnings, among other math computations or otherwise within the knowledge of one having ordinary skill in the art.

Figure 4:
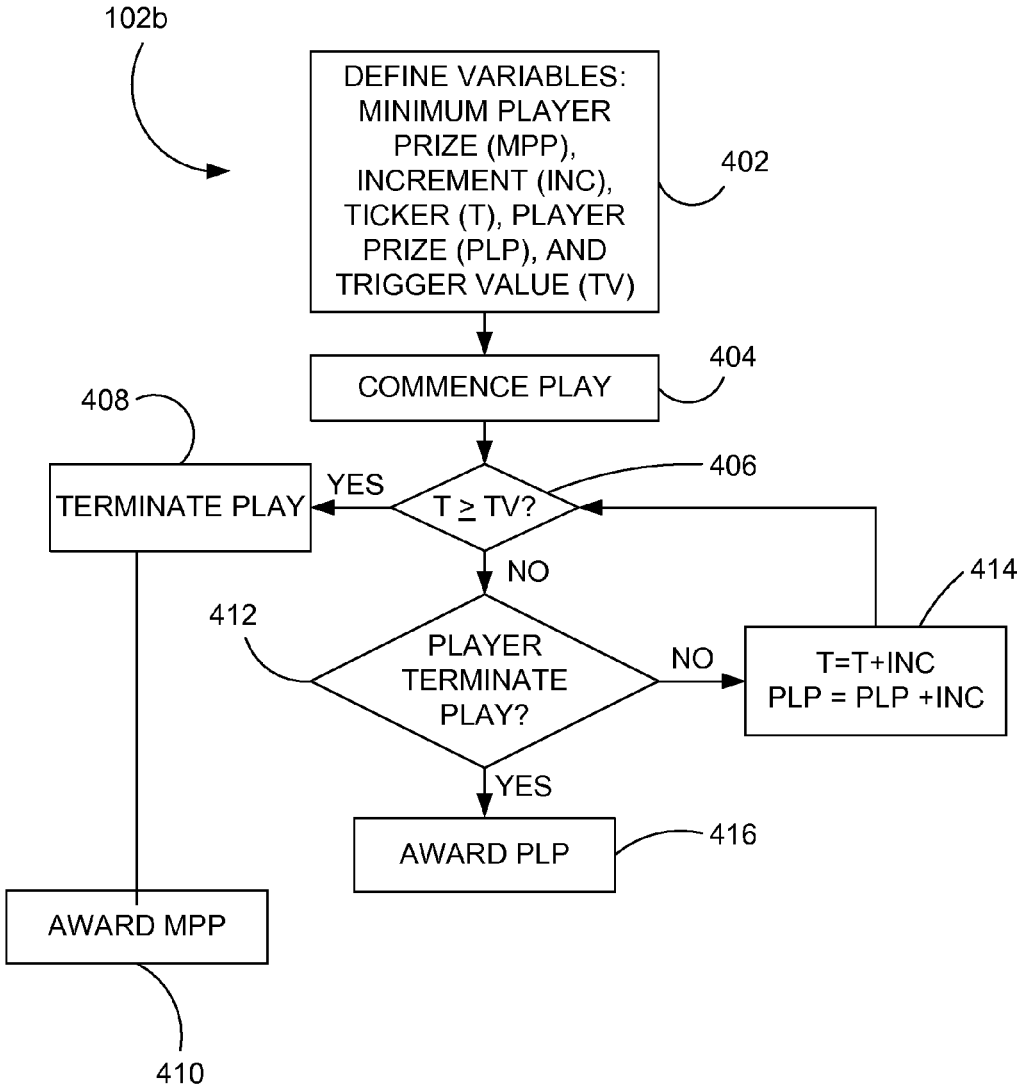
FIG. 4 is a flow diagram that illustrates another embodiment of an extended play gaming method.

Having described various embodiments of the gaming system 100, one should appreciate in the context of the disclosure that one method embodiment for implementing a bonus game, referred to also as gaming method 102*b* and illustrated in FIG. 4, comprises defining (e.g., initiating) variables or parameters (402). Such parameters include one or more of a minimum player prize (MPP), an increment value (INC), a counter or ticker (T), a player prize (PLP), and a trigger value (TV). Note that in some embodiments, one or more of these parameters may comprise default values that are programmed into the gaming software 102 and are configurable or variable, or, in some embodiments, are fixed. The minimum player prize represents a default compensation (e.g., dollar, credit, etc.) value that may be awarded to a player who continues play until or after the trigger value (measured in dollars, credits, etc.) has been reached. In alternate embodiments, multiple minimum player prizes (used in addition to setting a parameter for a player prize that progressively increases with increases in the ticker value and/or setting an increment value) may be set so that the player will be guaranteed a higher minimum player prize after the ticker surpasses that amount. For example, in the previously described embodiment with a starting point of $100 and an ending point of $500, other minimum player prizes may be in amounts of $200 and $400 if reached before game-initiated termination, in addition to or in lieu of the base minimum player prize of $100. Although the term "dollar" is used, it should be appreciated that other compensation or monetary values may be used, such as credits, free spins, or other monetary denominations.

Returning to the initially described embodiment with an increasing player prize, the player prize comprises a compensation value that increases over time of play, and which can be awarded in some embodiments to a player when the player terminates bonus play before the trigger value is reached. The increment value is a compensation value (e.g., either default or randomly generated) that is added to the ticker and/or the player prize as time of extended or bonus play progresses. For instance, the increment value can be a monetary value of $10. The ticker provides a basis for comparison to the trigger value as time of extended or bonus play progresses. In one embodiment, the ticker can equal zero at the start of bonus play, and as time progresses without player-initiated or game-initiated termination, is increased in increments of value INC (or in some embodiments, once the ticker advances to a threshold level, a minimum player prize is increased incrementally to a new compensation value of greater value than the previous minimum player prize). The trigger value comprises a compensation value equal to or less than a maximum value within a range of values displayed on the bonus payout indicator. For instance, the trigger value may comprise a maximum value or range relating to the difference between the total available winnings and the winnings achieved during the game that precedes the bonus game. The trigger value can be randomly selected up to the maximum, or a fixed value in some embodiments.

Continuing with the gaming method 102*b*, the bonus game play is commenced responsive to a triggering event (404), and a determination is made as to whether the ticker is greater than or equal to the trigger value (406). Note that bonus game play includes the various effects used to influence the player to terminate the game prematurely (e.g., before the trigger value is reached) as previously described. If the ticker value is greater than or equal to the trigger value, the method 102*b* terminates bonus play (408) and awards the player the minimum player prize (410). In other words, the player is "penalized" for not heeding the visual and/or audio effects that attempted to influence the player to terminate the game prematurely. In some implementations, the minimum player prize may be no prize or award at all. If the ticker is less than the trigger value (e.g., not greater than or equal to the trigger value), a determination is made as to whether the player terminated play (412). If the player terminated play, he or she is awarded the player prize (which is the original player prize defined before commencing play in addition to the incremented value achieved over the progression of time of bonus play) (416). If the player does not terminate play, then the ticker is incremented by the increment value and/or the player prize value is likewise incremented by the increment value (414), and processing returns to (406).

Variations of one or more of the above are contemplated to be within the scope of the disclosure, including skipping the increment for the player prize (e.g., in 414), varying the award amount, among other variations, such as the alternative embodiment set forth above. In addition, though described in the context of incremental values in, for instance, the ticker progression over time may result in a corresponding decrement to the ticker in some embodiments.

Figure 5:
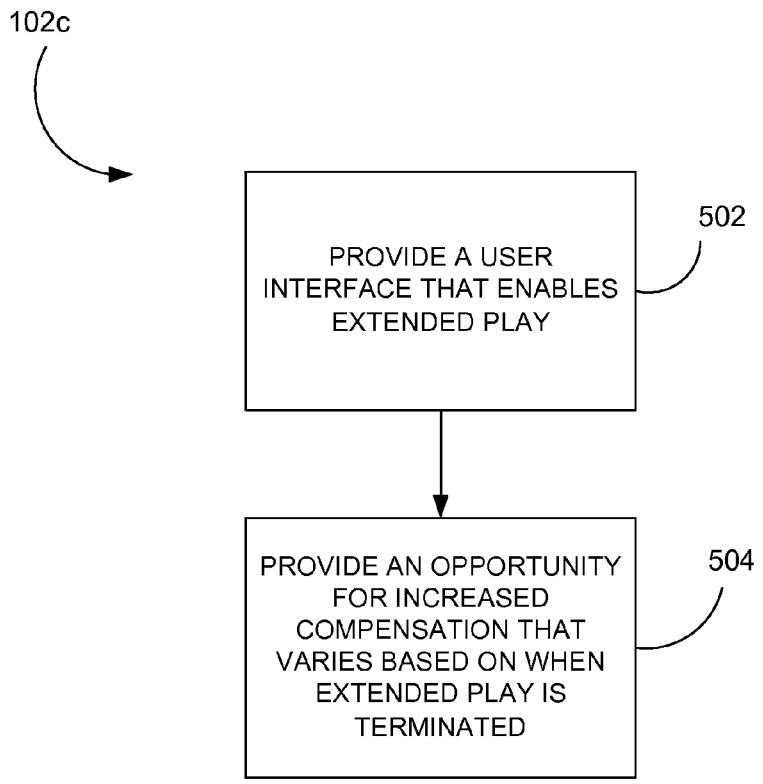
FIG. 5 is a flow diagram that illustrates an embodiment of a generalized extended play gaming method.

Another method embodiment, referred to also as gaming method 102*c*, is shown in FIG. 5, and comprises providing a user interface that enables extended play in an electronic game (502), and providing an opportunity for increased compensation that varies based on when extended play is terminated (504).

The flow diagrams of FIGS. 3-5 show the architecture, functionality, and operation of a possible implementation of the gaming system 100, and in particular, the gaming software 102. In this regard, each block represents a module, segment, or portion of code, which comprises one or more executable instructions for implementing the specified logical function(s). It should also be noted that in some alternative implementations, the functions noted in the blocks may occur out of the order noted in FIGS. 3-5. For example, two blocks shown in succession in FIGS. 3-5 may in fact be executed substantially concurrently or the blocks may sometimes be executed in the reverse order, depending upon the functionality involved, as will be further clarified hereinbelow.

Additionally, though described in the context of the architecture shown in FIG. 1, one having ordinary skill in the art should appreciate, in the context of the present disclosure, that the methods 102*a*-102*c* are not limited to implementation by the gaming system 100 shown in FIG. 1, but may be implemented in other system or apparatus embodiments as well.

It should be emphasized that the above-described embodiments are merely possible examples of implementations, merely set forth for a clear understanding of the principles of the disclosure. Many variations and modifications may be made to the above-described embodiments without departing substantially from the spirit and principles of the disclosure. All such modifications and variations are intended to be included herein within the scope of this disclosure and protected by the following claims.

At least the following is claimed:

1. A gaming system, comprising:

a memory with gaming software; and a processor configured with the gaming software to provide a user interface that enables extended play in an electronic game, the processor further configured with the gaming software to provide an opportunity for increased compensation that varies based on when the extended play is terminated by a player using a stop mechanism, the processor further configured to display on a gaming device display, a bonus payout indicator in the form of a substantially continuously incrementing non-numerical progressive graphic having an associated substantially continuously incrementing bonus payout award amount between a minimum and maximum payout award amount, the minimum and maximum payout award amounts displayed proximate the substantially continuously incrementing progressive graphic, the progressive graphic continuously incrementing until stopped by a player or the processor, the processor further configured to display one or more false game play ending indicators, wherein the one or more false game play ending indicators are configured to attempt to induce the player to initiate the stop mechanism.

2. The system of claim 1, wherein the processor is further configured with the software to define at least one of a trigger value, a player prize value, a minimum player prize value, an increment value, and a ticker value corresponding to progression of the extended play.

3. The system of claim 1, wherein the processor is further configured with the software to, determine whether a ticker value corresponding to progression of the extended play is greater than or equal to a trigger value, and responsive to determining that the ticker value is greater than or equal to the trigger value, terminate the extended play.

4. The system of claim 3, wherein the processor is further configured with the software to award a minimum player prize based on the termination of the extended play.

5. The system of claim 4, wherein the processor is further configured with the software to, responsive to determining that the ticker value is not greater than or equal to the trigger value, determine whether input corresponding to a user terminating play is received.

6. The system of claim 5, wherein the processor is further configured with the software to, responsive to determining that the input is not received, narrow the difference between the ticker value and the trigger value, and at least one of increase a player prize value and assign a minimum player prize to a new minimum value of increased compensation value.

7. The system of claim 5, wherein the processor is further configured with the software to, responsive to determining that the input is received, award a player prize with a compensation value larger than a minimum player prize and less than or equal to a maximum player prize.

8. The system of claim 1, wherein displaying one or more false game play ending indicators includes at least one of an audio effect, a visual effect, or a combination of audio and visual effects that appears to be one or more game ending triggering events.

9. A non-transitory computer readable medium having a computer program stored therein for providing extended play in an electronic game, comprising:

logic configured to provide a user interface that enables extended play;

logic configured to provide an opportunity for increased compensation that varies based on when extended play is terminated by a player using a stop mechanism; and logic configured to display on a gaming device display, a bonus payout indicator in the form of a substantially continuously incrementing non-numerical progressive graphic with an associated substantially continuously incrementing bonus payout award amount between a minimum and maximum payout award amount, the minimum and maximum payout award amounts displayed proximate the substantially continuously incrementing progressive graphic, the progressive graphic continuously incrementing until stopped by a player or the processor, the processor further configured to display one or more false game play ending indicators, wherein the one or more false game play ending indicators are configured attempt to induce the player to initiate the stop mechanism.

* * * * *